US011278106B2

(12) United States Patent
Lin

(10) Patent No.: US 11,278,106 B2
(45) Date of Patent: Mar. 22, 2022

(54) TRANSFORMABLE BAG

(71) Applicant: NEW CENTURY PRODUCTS LIMITED, New Taipei (TW)

(72) Inventor: Fu-Tsun Lin, New Taipei (TW)

(73) Assignee: NEW CENTURY PRODUCTS LIMITED, New Taipei (TW)

( * ) Notice: Subject to any disclaimer, the term of this patent is extended or adjusted under 35 U.S.C. 154(b) by 6 days.

(21) Appl. No.: 16/903,593

(22) Filed: Jun. 17, 2020

(65) Prior Publication Data

US 2021/0244164 A1 Aug. 12, 2021

(30) Foreign Application Priority Data

Feb. 12, 2020 (TW) ..... 109201504

(51) Int. Cl.

| | |
|---|---|
| ***A45F 4/08*** | (2006.01) |
| ***A47D 13/02*** | (2006.01) |
| ***A45F 3/02*** | (2006.01) |
| *A45F 3/00* | (2006.01) |

(52) U.S. Cl.

CPC ..... *A45F 4/08* (2013.01); *A45F 3/02* (2013.01); *A47D 13/02* (2013.01); *A45F 2003/003* (2013.01)

(58) Field of Classification Search

CPC ..... A47D 13/02; A47D 13/063; A47D 9/005; A47D 15/003; A47D 7/002; A45F 4/06; A45F 4/08

USPC ..... 224/581–582, 156; 192/2; 5/99.1

See application file for complete search history.

(56) References Cited

U.S. PATENT DOCUMENTS

| | | | | |
|---|---|---|---|---|
| 2,780,817 A * | 2/1957 | Jackson | A47D 7/002 | 5/99.1 |
| 3,492,680 A * | 2/1970 | Coolidge | A47D 9/005 | 5/99.1 |
| 4,999,863 A * | 3/1991 | Kane | A45C 9/00 | 190/2 |
| 7,389,897 B2 * | 6/2008 | Pistiolis | A45C 9/00 | 224/158 |

FOREIGN PATENT DOCUMENTS

| | | | | |
|---|---|---|---|---|
| GB | 2552227 A * | 1/2018 | A45C 7/0072 | |

* cited by examiner

*Primary Examiner* — Scott T McNurlen
(74) *Attorney, Agent, or Firm* — Leong C. Lei

(57) ABSTRACT

A transformable bag includes a first storage unit and a second storage unit connected with each other, and a third storage unit disposed between the first storage unit and the second storage unit. The first storage unit and the second storage unit are respectively connected to two side edges of the third storage unit by two connecting units. When the first storage unit and the second storage unit are away from each other, the third storage unit is stretched to form a placing space for an infant to rest or changing diapers. When the first storage unit and the second storage unit are close to each other, the third storage unit is stored between the first storage unit and the second storage unit, and the third storage unit can be removed to release a storage space between the first storage unit and the second storage unit.

7 Claims, 4 Drawing Sheets

TRANSFORMABLE BAG

FIELD OF INVENTION

The present invention relates to a bag, and more particularly to a transformable bag applied in the field of baby care.

RELATED ART

Generally, parents often swaddle the sleeping infant with their hands when they bring the infant outside with them, so infant swaddling clothes or bags are available on the market to relieve the problem of over fatigue of the parents' arms. But the weight of infant is still bore by the shoulders of the parents, so there is another multi-purpose handbag with both storage and sleeping bag functions sold on the market. However, because the multi-purpose handbag is equipped with the sleeping bag function, a lot of storage space is sacrificed. Therefore, after the infant has grown up and no longer needs to be swaddled, the multi-purpose handbag no longer meets the storage needs of the parents, resulting in waste of resources.

In view of the various drawbacks derived from the above conventional methods, the inventor of the present invention has been eager to improve and innovate. After years of painstaking and diligent research, finally a transformable bag of the present invention is developed successfully.

SUMMARY OF THE INVENTION

In order to solve the above-mentioned problems of the prior art, an object of the present invention is to provide a transformable bag combining a bag and a sleeping basket bed for infants to rest and changing diapers, and the sleeping basket bed can be removed to increase a storage space of the bag.

A transformable bag of the present invention includes a first storage unit and a second storage unit connected with each other, and a third storage unit disposed between the first storage unit and the second storage unit. Wherein, the second storage unit is movably disposed on the first storage unit to form a storage space between the first storage unit and the second storage unit, and the third storage unit is used as a spacing to form a placing space between the first storage unit, the second storage unit and the third storage unit. When the first storage unit and the second storage unit are combined, the third storage unit is stored in the storage space.

The first storage unit includes a first body, a first connecting unit and a second connecting unit. The first body includes a first bag surface, a second bag surface and a first side surface, the first bag surface and the second bag surface face each other and are spaced apart at a certain distance, and two side edges of the first side surface are surroundingly disposed between the first bag surface and the second bag surface, so that the first bag surface, the second bag surface and the first side surface jointly form a first accommodating space. Wherein, the first connecting unit is wound around the second bag surface, and the second connecting unit is disposed along the second bag surface in a U-shape close to sides of the first connecting unit.

The second storage unit includes a second body, a third connecting unit, and a fourth connecting unit. The second body includes a third bag surface and a second side surface, and side edges of the second side surface are wound around the third bag surface so that the third bag surface and the second side surface jointly form a second accommodating space. Wherein the third connecting unit is wound around the second side surface, and the fourth connecting unit is disposed along the second side surface in a U-shape close to sides of the third bag surface.

Wherein when the first storage unit and the second storage unit are combined, the first connecting unit and the third connecting unit are correspondingly connected to each other, and the second connecting unit and the fourth connecting unit are disposed between the first body and the second body. Wherein the third storage unit includes a deformable body, a fifth connecting unit, and a sixth connecting unit. Wherein the deformable body is stored in the storage space or unfolded to form the placing space with the first storage unit and the second storage unit. Wherein the fifth connecting unit is disposed on a side edge of the deformable body facing the second connecting unit, and connected to the second connecting unit. Wherein the sixth connecting unit is disposed on a side edge of the deformable body facing the fourth connecting unit, and connected to the fourth connecting unit. Wherein when the fifth connecting unit is connected to the second connecting unit, and the sixth connecting unit is connected to the fourth connecting unit, another two sides of the deformable body are simultaneously pulled by the second connecting unit and the fourth connecting unit to fold inwardly toward an inner side of the deformable body, so that the other two sides of the deformable body stand on the inner side of the deformable body. Wherein the first storage unit, the second storage unit, the third storage unit and the other two sides of the deformable body form the placing space.

Wherein the third storage unit is further disposed with a seventh connecting unit, the second storage unit is further disposed with an eighth connecting unit, and the seventh connecting unit and the eighth connecting unit are correspondingly connected to each other. Wherein the seventh connecting unit is disposed adjacent to the side edge of the deformable body facing toward the second body, and the seventh connecting unit is disposed closer to the inner side of the deformable body than the sixth connecting unit. Wherein the eighth connecting unit is disposed on the second side surface and located between the fourth connecting unit and the third connecting unit.

Wherein a central position of the deformable body is further disposed with a support pad, the support pad is used to keep a bottom of the deformable body in a flat state, a soft pad is disposed on the support pad, and the soft pad is used to increase the comfort of the deformable body.

Wherein the deformable body is disposed with more than two support units at positions adjacent to the other two sides, the support units are used to make the other two sides of the deformable body stand, and at least one folding unit with a mesh structure is further disposed between each of the support units, with each of the support units and the folding unit, the deformable body is stored in the storage space or unfolded to form the placing space.

Wherein when the first storage unit and the second storage unit are combined, the deformable body is folded and stored between the first storage unit and the second storage unit.

Wherein when the second connecting unit is separated from the fifth connecting unit, and the fourth connecting unit is also separated from the sixth connecting unit, the deformable body can be removed from between the first storage unit and the second storage unit.

Wherein the first connecting unit and the third connecting unit are corresponding zippers, buckles, VELCRO strip fasteners, or any connecting elements that can be used for connecting items. The second connecting unit and the fifth connecting unit are corresponding zippers, buckles, VEL- CRO strip fasteners, or any connecting elements that can be used for connecting items. The fourth connecting unit and the sixth connecting unit are corresponding zippers, buckles, VELCRO strip fasteners, or any connecting elements that can be used for connecting items. And, the seventh connecting unit and the eighth connecting unit are corresponding zippers, buckles, VELCRO strip fasteners, or any connecting elements that can be used for connecting items.

Wherein the first storage unit and the second storage unit are further disposed with at least one pocket.

Wherein the first storage unit and the second storage unit are further disposed with a shoulder strap, a side strap, a hand strap, or a combination of two or more of the above.

A transformable bag of the present invention includes a first storage unit and a second storage unit, wherein the second storage unit is movably dismountably disposed on the first storage unit to form a storage space between the second storage unit and the first storage unit. Wherein a position at the first storage unit corresponding to the storage space is connected to one end of an external third storage unit, and a position at the second storage unit corresponding to the storage space is connected to another end of the external third storage unit.

Wherein the first storage unit further includes a first body, a first connecting unit and a second connecting unit. The first body includes a first bag surface, a second bag surface and a first side surface, the first bag surface and the second bag surface face each other and are spaced apart at a certain distance, and two side edges of the first side surface are surroundingly disposed between the first bag surface and the second bag surface, so that the first bag surface, the second bag surface and the first side surface jointly form a first accommodating space. The first connecting unit is wound around the second bag surface, the second connecting unit is disposed along the second bag surface close to sides of the first connecting unit, and two ends of the second connecting unit are not connected with each other.

Wherein the second storage unit further includes a second body, a third connecting unit, and a fourth connecting unit. The second body includes a third bag surface and a second side surface, and side edges of the second side surface are wound around the third bag surface so that the third bag surface and the second side surface jointly form a second accommodating space. The third connecting unit is wound around the second side surface, the fourth connecting unit is disposed along the second side surface close to sides of the third bag surface, and two ends of the fourth connecting unit are not connected with each other.

Wherein when the first storage unit and the second storage unit are combined, the first connecting unit and the third connecting unit are correspondingly connected to each other, and the second connecting unit and the fourth connecting unit are disposed between the first storage unit and the second storage unit.

The transformable bag of the present invention is a bag with functions of storage, and for infants to rest and changing diapers. When the first storage unit and the second storage unit are away from each other, the placing space of the third storage unit can be used as a temporary sleeping basket bed, and the soft pad is placed in the sleeping basket bed for infants to rest or changing diapers, so as to solve the physiological needs of infants when they are outside. When the first storage unit and the second storage unit are close to each other, the third storage unit can be stored between the first storage unit and the second storage unit, and the third storage unit can be removed to release the storage space between the first storage unit and the second storage unit.

The following embodiments in conjunction with the accompanied drawings describe the above description in detail, and provide a further explanation for the technical solution of the present invention.

BRIEF DESCRIPTION OF THE DRAWINGS

The techniques of present invention would be more understandable from the detailed description given herein below and the accompanying figures are provided for better illustration, and thus description and figures are not limitative for present invention, and wherein.

DETAILED DESCRIPTION OF THE INVENTION

Figure 1:
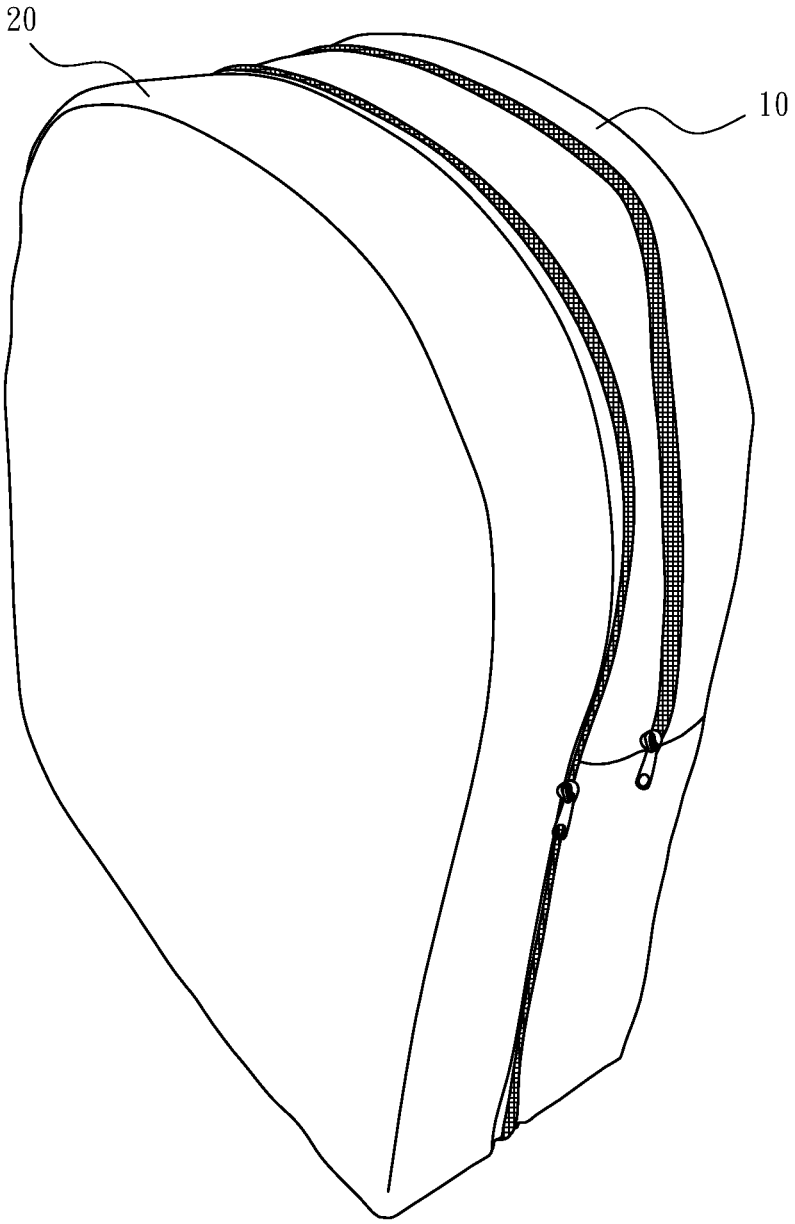
FIG. 1 is a perspective view of a transformable bag of the present invention.
Figure 2:
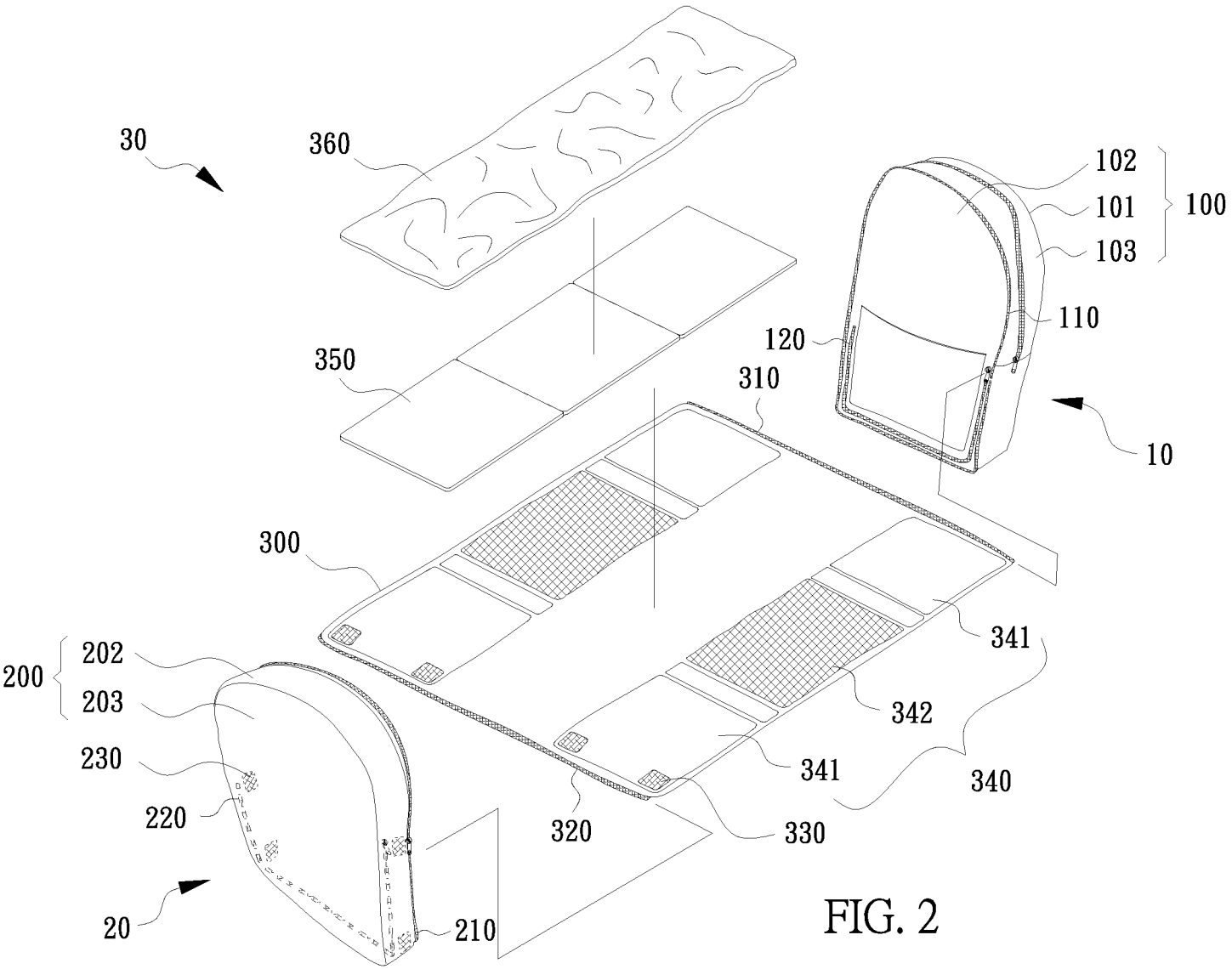
FIG. 2 is an exploded perspective view of the transformable bag of the present invention.
Figure 3:
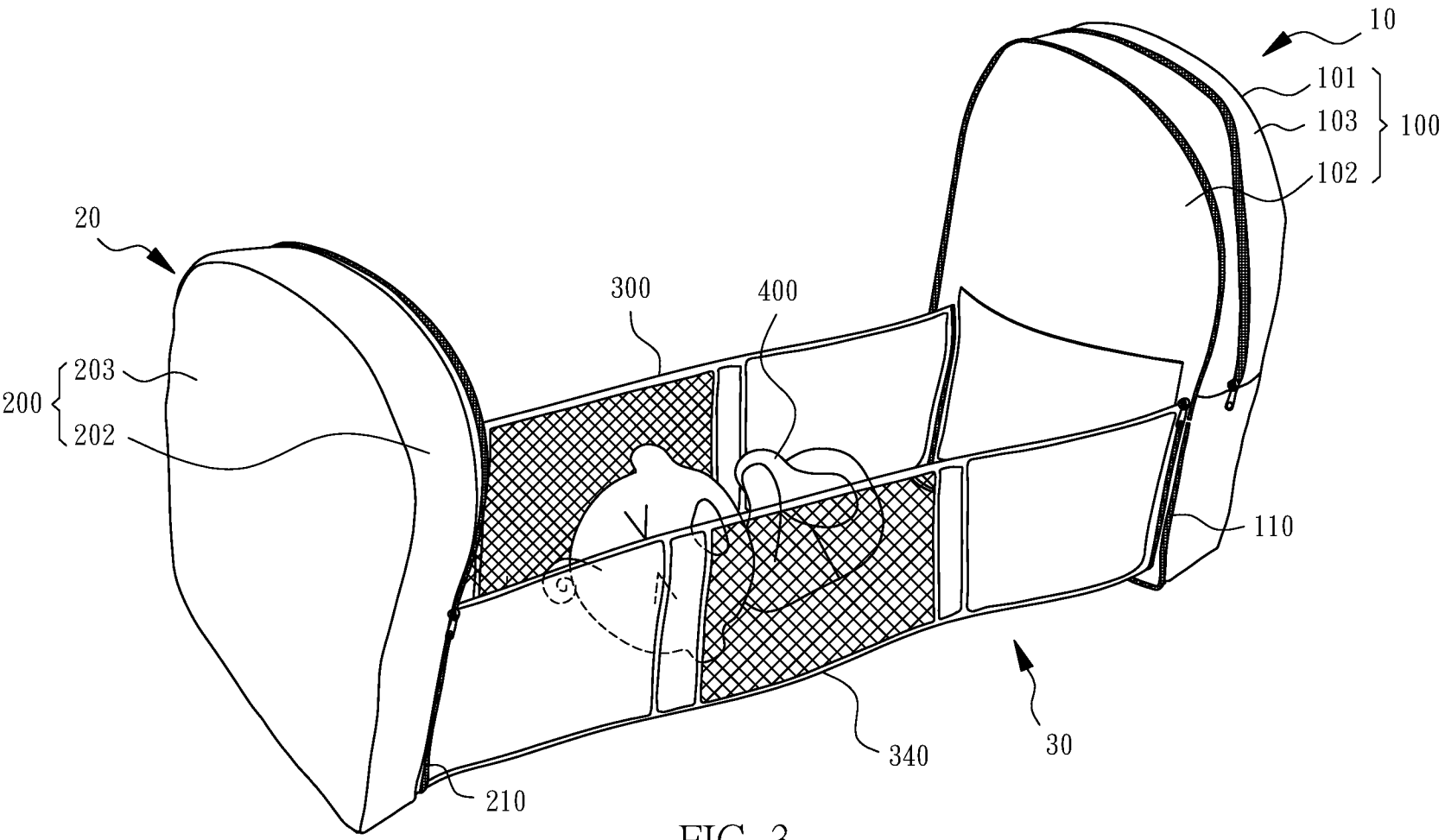
FIG. 3 is a perspective view of the transformable bag of the present invention being used.

Please refer to FIG. 1 to FIG. 3, which are perspective view, exploded perspective view of a transformable bag of the present invention, and perspective view of the transformable bag of the present invention being used. The transformable bag mainly includes a first storage unit 10, a second storage unit 20 and a third storage unit 30. Wherein the third storage unit 30 is folded and stored between the first storage unit 10 and the second storage unit 20. When the first storage unit 10 and the second storage unit 20 are spaced apart by the third storage unit 30, the third storage unit 30 is stretched to form a resting space for an infant 400.

Please refer to FIGS. 2 to 3 again, wherein the first storage unit 10 includes a first body 100, a first connecting unit 110 and a second connecting unit 120. The first body 100 includes a first bag surface 101, a second bag surface 102 and a first side surface 103, and a first accommodating space is provided between the first bag surface 101, the second bag surface 102 and the first side surface 103. The first connecting unit 110 is disposed on side edges of the second bag surface 102, and the second connecting unit 120 is disposed adjacent to the side edges of the second bag surface 102, wherein the second connecting unit 120 is closer to an inner side of the first body 100 than the first connecting unit 110, and the second connecting unit 120 is disposed along the second bag surface 102 in a U-shape close to sides of the first connecting unit 110.

The second storage unit 20 includes a second body 200, a third connecting unit 210, and a fourth connecting unit 220. The second body 200 includes a third bag surface 203 and a second side surface 202, and side edges of the second side surface 202 are wound around the third bag surface 203 so that the third bag surface 203 and the second side surface 202 jointly form a second accommodating space. The third connecting unit 210 is wound around the second side surface 202, and the fourth connecting unit 220 is disposed along the second side surface 202 in a U-shape close to sides of the third bag surface 203.

The third storage unit 30 includes a deformable body 300, a fifth connecting unit 310, and a sixth connecting unit 320. The deformable body 300 is a bendable plane. The fifth connecting unit 310 is disposed on a side edge of the deformable body 300 facing toward the second connecting unit 120, and the second connecting unit 120 and the fifth connecting unit 310 are correspondingly connected to each other. The sixth connecting unit 320 is disposed on a side edge of the deformable body 300 facing toward the fourth connecting unit 220, and the fourth connecting unit 220 and the sixth connecting unit 320 are correspondingly connected to each other.

When the fifth connecting unit 310 is connected to the second connecting unit 120, and the sixth connecting unit 320 is connected to the fourth connecting unit 220, another two sides 340 of the deformable body 300 are simultaneously pulled by the second connecting unit 120 and the fourth connecting unit 220 toward a center position of the deformable body 300, so that the other two sides 340 of the deformable body 300 stand on an inner side of the deformable body 300.

Wherein the first storage unit 10, the second storage unit 20, the third storage unit 30, and the other two sides 340 of the deformable body 300 form a placing space. A support pad 350 is further disposed at the center position of the deformable body 300, a soft pad 360 is further disposed on the support pad 350, and the soft pad 360 can be used as a space for the infant 400 to rest or changing diapers.

The other two sides 340 of the deformable body 300 are further disposed with four support units 341, and a folding unit 342 with a mesh structure is disposed between each of the support units 341. Near the side edge of the deformable body 300 facing the second body 200 is further disposed with a seventh connecting unit 330, wherein the seventh connecting unit 330 is closer to the inner side of the deformable body 300 than the sixth connecting unit 320.

The second body 200 is further disposed with an eighth connecting unit 230, wherein the eighth connecting unit 230 is disposed on the second side surface 202 and located between the fourth connecting unit 220 and the third connecting unit 210. When the second body 200 is connected to the deformable body 300, the seventh connecting unit 330 and the eighth connecting unit 230 are correspondingly connected to each other.

Wherein the first connecting unit 110 and the third connecting unit 210 are correspondingly connected zippers, the second connecting unit 120 and the fifth connecting unit 310 are correspondingly connected zippers, the fourth connecting unit 220 and the sixth connecting unit 320 are correspondingly connected zippers, and the seventh connecting unit 330 and the eighth connecting unit 230 are correspondingly connected VELCRO strip fastener sets.

Figure 4:
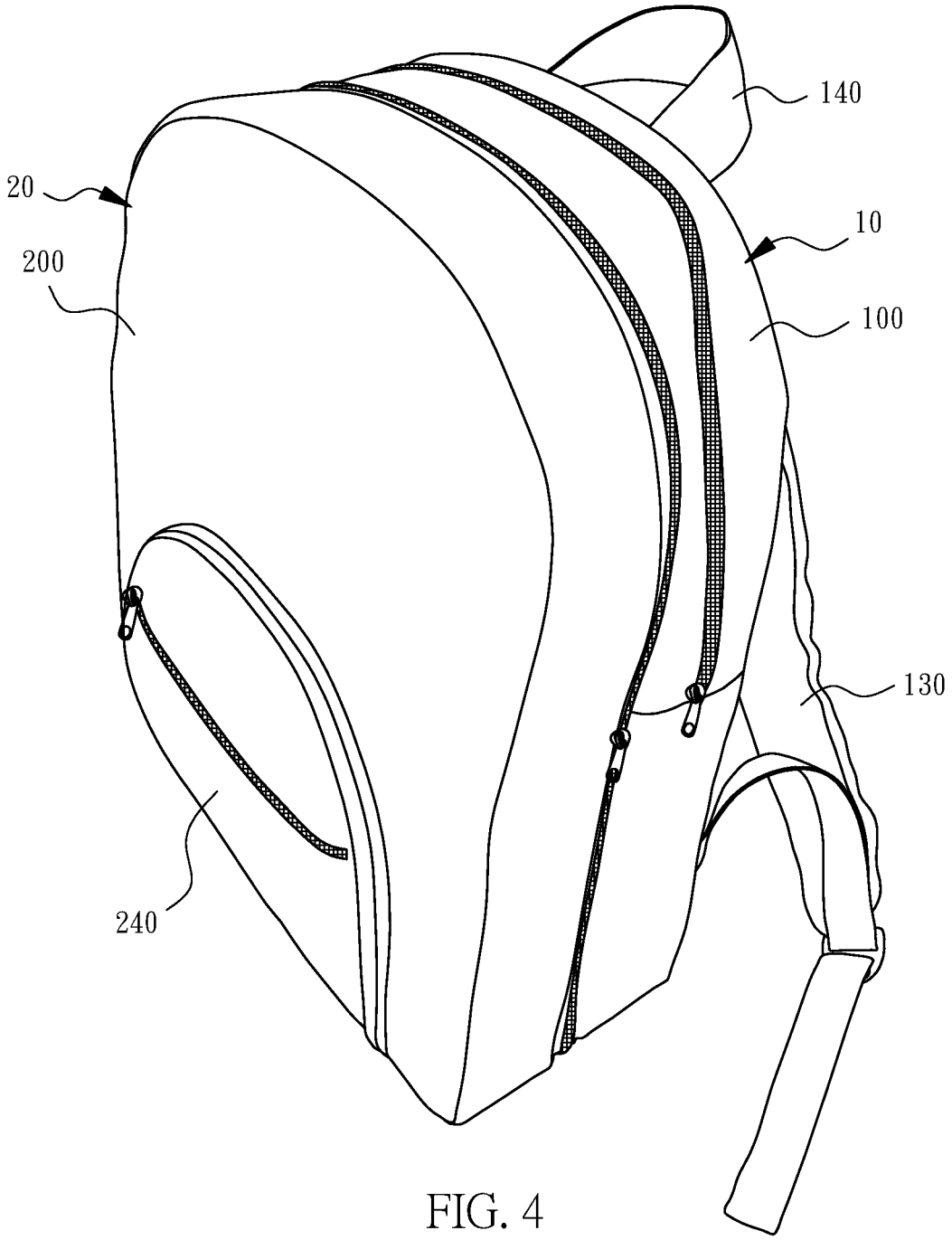
FIG. 4 is another perspective view of the transformable bag of the present invention.

Please refer to FIG. 4 for another perspective view of the transformable bag of the present invention. The first storage unit 10 and the second storage unit 20 are connected, and the third storage unit 30 (not shown in FIG. 4) is removed from between the first storage unit 10 and the second storage unit 20. The second connecting unit 120 (not shown in FIG. 4) and the fourth connecting unit 220 (not shown in FIG. 4) are hidden between the first body 100 and the second body 200. The first storage unit 10 is further disposed with a shoulder strap 130 and a hand strap 140, and the second storage unit 20 is further disposed with a pocket 240.

The infant swaddling clothes or bags of the prior art require the parents to bear a weight of the infant 400 for a long period of time when the parents bring the infant 400 outside. As for another prior art of multi-purpose handbag with both storage and sleeping bag functions, because the sleeping bag function sacrifices a lot of storage space, after the infant 400 has grown up and no longer needs to be swaddled, the multi-purpose handbag no longer meets the storage needs of the parents, resulting in waste of resources.

The transformable bag of the present invention is a bag with functions of storage, and for the infant 400 to rest and changing diapers. When the first storage unit 10 and the second storage unit 20 are away from each other, the placing space of the third storage unit 30 can be used as a temporary sleeping basket bed, and the soft pad 360 is placed in the sleeping basket bed for the infant 400 to rest or changing diapers, so as to solve the physiological needs of the infant 400 when the parents bring the infant 400 outside. When the first storage unit 10 and the second storage unit 20 are close to each other, the third storage unit 30 can be stored between the first storage unit 10 and the second storage unit 20, or the third storage unit 30 can be removed to release the storage space between the first storage unit 10 and the second storage unit 20.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A transformable bag comprising:

a first bag portion;

a second bag portion, the second bag portion being movably disposed on the first bag portion to form a first configuration in which a storage space is formed between the second bag portion and the first bag portion and a second configuration in which the second bag portion and the first bag portion are disassembled and set apart by a spacing; and a soft sheet, the soft sheet being disposed between the first bag portion and the second bag portion and the soft sheet being stored in the storage space when the first bag portion and the second bag portion are in the first configuration, when the first bag portion and the second bag portion are in the second configuration, the first bag portion and the second bag portion being spaced apart by the soft sheet as the spacing to form a placing space between the first bag portion, the second bag portion and the soft sheet;

wherein the first bag portion further includes:

a first body including:

a first bag surface;

a second bag surface, the first bag surface and the second bag surface face each other and are spaced apart at a certain distance; and a first side surface, two side edges of the first side surface are surroundingly disposed between the first bag surface and the second bag surface, so that the first bag surface, the second bag surface and the first side surface jointly form a first accommodating space;

a first zipper, the first zipper is wound around the second bag surface; and a second zipper, the second zipper is disposed along the second bag surface close to sides of the first zipper, and two ends of the second zipper are not connected with each other;

the second bag portion further includes:

a second body including:

a third bag surface; and a second side surface, side edges of the second side surface are wound around the third bag surface so that the third bag surface and the second side surface jointly form a second accommodating space;

a third zipper, the third zipper is wound around the second side surface; and a fourth zipper, the fourth zipper is disposed along the second side surface close to sides of the third bag surface, and two ends of the fourth zipper are not connected with each other;

wherein when the first bag portion and the second bag portion are combined, the first zipper and the third zipper are correspondingly connected to each other, and the second zipper and the fourth zipper are disposed between the first body and the second body; and the soft sheet further includes:

a deformable body, the deformable body is stored in the storage space or unfolded to form the placing space with the first bag portion and the second bag portion;

a fifth zipper, the fifth zipper is disposed on a side edge of the deformable body facing the second zipper, and connected to the second zipper; and a sixth zipper, the sixth zipper is disposed on a side edge of the deformable body facing the fourth zipper, and connected to the fourth zipper;

wherein when the fifth zipper is connected to the second zipper, and the sixth zipper is connected to the fourth zipper, another two sides of the deformable body are simultaneously pulled by the second zipper and the fourth zipper to fold inwardly toward an inner side of the deformable body, so that the another two sides of the deformable body stand upright; and wherein the first bag portion, the second bag portion, the soft sheet and the other two sides of the deformable body form the placing space.

2. The transformable bag as claimed in claim 1, wherein the soft sheet is further disposed with a first hook and loop, the first hook and loop is disposed beside the sixth zipper, wherein the first hook and loop is disposed closer to the inner side of the deformable body than the sixth zipper;

wherein the second bag portion is further disposed with a second hook and loop, the second hook and loop is disposed on the second side surface and located between the fourth zipper and the third zipper; and wherein when the second bag portion is connected to the soft sheet, the first hook and loop and the second hook and loop are correspondingly connected to each other.

3. The transformable bag as claimed in claim 1, further including a support pad disposed at a central position of the deformable body.

4. The transformable bag as claimed in claim 3, wherein a soft pad is further disposed on the support pad.

5. The transformable bag as claimed in claim 1, wherein the deformable body further includes:

more than two support units disposed at positions adjacent to the another two sides of the deformable body, each of the support units keeps the another two sides of the deformable body standing; and at least one folding unit disposed between each of the support units; with each of the support units and the folding unit, the deformable body is stored in the storage space or unfolded to form the placing space.

6. The transformable bag as claimed in claim 5, wherein the folding unit is a mesh structure.

7. A transformable bag comprising:

a first bag portion; and a second bag portion, the second bag portion being movably dismountably disposed on the first bag portion to form a storage space between the second bag portion and the first bag portion;

wherein a position at the first bag portion is connected to one end of an external soft sheet, and a position at the second bag portion is connected to another end of the external soft sheet;

wherein the first bag portion further includes:

a first body including:

a first bag surface;

a second bag surface, the first bag surface and the second bag surface face each other and are spaced apart at a certain distance; and a first side surface, two side edges of the first side surface are surroundingly disposed between the first bag surface and the second bag surface, so that the first bag surface, the second bag surface and the first side surface jointly form a first accommodating space;

a first zipper, the first zipper is wound around the second bag surface; and a second zipper, the second zipper is disposed along the second bag surface close to sides of the first zipper, and two ends of the second zipper are not connected with each other;

the second bag portion further includes:

a second body including:

a third bag surface; and a second side surface, side edges of the second side surface are wound around the third bag surface so that the third bag surface and the second side surface jointly form a second accommodating space;

a third zipper, the third zipper is wound around the second side surface; and a fourth zipper, the fourth zipper is disposed along the second side surface close to sides of the third bag surface, and two ends of the fourth zipper are not connected with each other;

wherein when the first bag portion and the second bag portion are combined, the first zipper and the third zipper are correspondingly connected to each other, and the second zipper and the fourth zipper are disposed between the first bag portion and the second bag portion.

* * * * *